US009165559B2

(12) United States Patent
Baum et al.

(10) Patent No.: US 9,165,559 B2
(45) Date of Patent: Oct. 20, 2015

(54) METHOD AND APPARATUS FOR FREQUENCY DOMAIN WATERMARK PROCESSING A MULTI-CHANNEL AUDIO SIGNAL IN REAL-TIME

(76) Inventors: Peter Georg Baum, Hannover (DE); Ulrich Gries, Hannover (DE); Michael Arnold, Isernhagen (DE); Xiaoming Chen, Hannover (DE)

( * ) Notice: Subject to any disclaimer, the term of this patent is extended or adjusted under 35 U.S.C. 154(b) by 603 days.

(21) Appl. No.: 13/562,849

(22) Filed: Jul. 31, 2012

(65) Prior Publication Data

US 2013/0051564 A1 Feb. 28, 2013

(30) Foreign Application Priority Data

Aug. 23, 2011 (EP) ..... 11306062

(51) Int. Cl.
*G10L 19/018* (2013.01)
*G10L 19/008* (2013.01)

(52) U.S. Cl.
CPC ..... *G10L 19/018* (2013.01); *G10L 19/008* (2013.01)

(58) Field of Classification Search
CPC ..... G10L 19/018; G10L 19/008; G06F 21/10
USPC ..... 700/94; 381/1, 17–19, 22, 23; 713/173, 713/176; 712/220, 234; 380/236, 237, 253
See application file for complete search history.

(56) References Cited

U.S. PATENT DOCUMENTS

| | | | | |
|---|---|---|---|---|
| 2002/0120849 | A1 | 8/2002 | McKinley et al. | |
| 2007/0300066 | A1 | 12/2007 | Srinivasan | |
| 2009/0074185 | A1 * | 3/2009 | Srinivasan et al. | 380/255 |
| 2010/0246810 | A1 | 9/2010 | Srinivasan et al. | |

FOREIGN PATENT DOCUMENTS

| | | |
|---|---|---|
| KR | 20020053980 | 7/2002 |
| WO | WO0029968 | 5/2000 |
| WO | WO2009107054 | 9/2009 |
| WO | WO2010148227 | 12/2010 |

OTHER PUBLICATIONS

Murata et al., "Multichannel Audio Watermarking method suitable for Multiple Watermarks", International Symposium on Communications & Information Technology (SCIT), Vientiane, Laos, Oct. 21, 2008, pp. 375-379.

(Continued)

*Primary Examiner* — Vivian Chin
*Assistant Examiner* — David Ton

(57) ABSTRACT

Digital audio signal watermarking in real-time is difficult in an environment that has limited processing power. According to the invention, the channels in a data block-based audio multi-channel signal are prioritized with respect to watermarking importance, whereby the channel priority can change for different input signal data blocks. For a current input signal block, the most important channel is watermarked and the required processing time is determined. If this required processing time is shorter than a predefined application-dependent threshold, the next most important channel is marked and the additionally required processing time is determined, and so on. Due to the block-based nature of the audio watermarking including block overlap/add and due to the sensitivity of the resulting audio quality against blocking artifacts, several problems are solved in order to lead to acceptable performance and quality.

7 Claims, 4 Drawing Sheets

(56) References Cited

OTHER PUBLICATIONS

Figure 1:
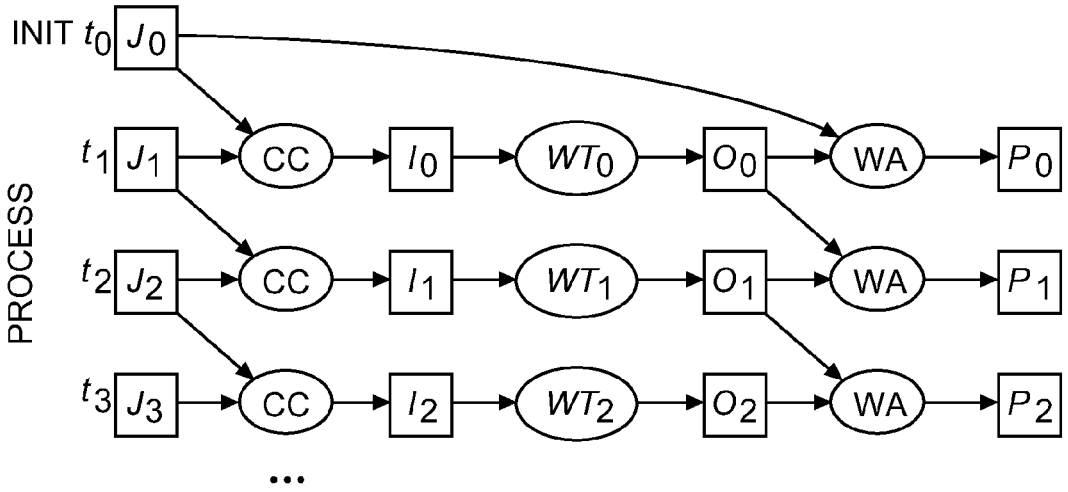

Jarnikov et al., "Server-guided watermarking for resource-constrained devices", 13th IEEE International Symposium on Consumer Electronics (ISCE), Kyoto, Japan, May 25, 2009, pp. 76-80.

Murata, Harumi, "Multichannel Audio Watermarking Method γ Multiple Embessing", International Symposium on Information Therory and its Applications, ISITA2008, Auckland, New Zealand, Dec. 7-10, 2008.

European Search Report dated Nov. 10, 2011.

* cited by examiner

METHOD AND APPARATUS FOR FREQUENCY DOMAIN WATERMARK PROCESSING A MULTI-CHANNEL AUDIO SIGNAL IN REAL-TIME

This application claims the benefit, under 35 U.S.C. §119 of EP Patent Application 11306062.8, filed 23 Aug. 2011.

The invention relates to a method and to an apparatus for frequency domain watermark processing a multi-channel audio signal in real-time, wherein enough processing power is not available in any case for watermark processing all channels of a current input section of the audio signal, and wherein for the watermark processing the audio signal is processed per channel in an overlap/add manner.

BACKGROUND

Digital audio signal watermarking in real-time is difficult in an environment that has limited processing power. This is for example the case on an embedded platform in which due to cost, heat and loudness reasons usually low power processing units are used, or in a server in which a powerful processor has to watermark in real-time several data streams in parallel.

Usually audio watermarking systems are operating in a block based manner where the watermark (WM) embedder gets a block of N input signal samples, WM processes this block and returns a block of N modified output signal samples. Real-time means that the time period available for WM processing of a signal data block is shorter than the time period used to get the next signal data block. If the WM processing time is longer, the real-time constraint is violated and a buffer overflow at the input of the embedder will occur, which leads to dropping of samples and audible artifacts and degradation of the audio quality.

In addition, the processing time required for watermark embedding is often audio signal content-dependent.

INVENTION

It is therefore important to ensure watermarking processing for an audio data stream without violating the real-time constraint. On one hand this means that in most cases not all channels in a multi-channel data stream can be marked. On the other hand, it is advantageous to watermark as many channels of an audio data stream as possible in order to increase robustness and security of the watermark. In 5.1 channel audio, for example, the WM robustness and security decreases a lot if only the centre channel is watermarked instead of the left, centre and right channels or all six channels.

In order to guarantee real-time processing in the above-mentioned restricted environment, a worst-case input signal has to be found for which the watermark embedder will need the longest processing time. Based on such time period the maximum number of channels, which can be marked in real-time, can be calculated. However, the disadvantage of such solution is that most input signals can be processed faster than the above-mentioned worst-case input signal, and that most of the time the embedder watermarks less channels than possible, which decreases robustness and security.

A problem to be solved by the invention is to provide a watermark processing with real-time constraint in which as many audio input signal channels as possible can be watermarked.

According to the invention, the channels in a data block-based audio multi-channel signal are prioritized with respect to watermarking importance, whereby the channel priority can change for different input signal data blocks. For a current input signal block, the most important channel is watermarked, for example the centre channel in a 5.1 setting, and the required processing time is determined. If this required processing time is shorter than a predefined application-dependent threshold, the next most important channel (for example the left channel) is marked and the additionally required processing time is determined. In this way, the channels in decreasing importance are successively marked for the current input signal block until the totally required processing time is longer than a predefined processing time threshold. Thereafter the remaining channels are not watermarked, but only the necessary audio processing is performed, so that no blocking artifacts will occur. Such 'anti-blocking processing' (cf. description below) is usually much faster than the full WM embedding processing and therefore this way of procedure will guarantee the adherence of the real-time constraint.

Due to the block-based nature of audio coding and watermarking and due to the sensitivity of the resulting audio quality against blocking artifacts, several problems have to be solved in order to lead to acceptable performance and quality.

The invention optimizes the trade-off between WM robustness and security on one hand and the real-time processing constraint on the other hand.

In principle, the inventive method is suited for frequency domain watermark processing a multi-channel audio signal in real-time, wherein enough processing power is not available in any case for watermark processing all channels of a current input section of said audio signal, and wherein for said watermark processing said audio signal is processed per channel in an overlap/add manner for the current input section of said audio signal and the following input section of said audio signal, said method including the steps:

a) determining or considering for said current input section of said audio signal a channel priority list;
b) if enough processing power is available for watermark processing the first channel of said channel priority list, watermarking the audio content of said first channel, wherein the watermark processing includes:
   concatenating the input data blocks of this channel of said current input section of said audio signal and the following input section of said audio signal;
   amplitude weighting, frequency transforming, watermarking and inverse frequency transforming said concatenated input data blocks;
   amplitude weighting and adding the two resulting data blocks, wherein for the first section of all channels of the data stream of said audio signal the corresponding data block is amplitude weighted and added without prior watermarking processing;
   else, not watermarking the audio content of this channel, and passing through the corresponding input data block;
c) repeating step b) for the remaining channels of said current input section of said audio signal, and continuing for the following input section of said audio signal with step b) and the first channel.

In principle the inventive apparatus is suited for frequency domain watermark processing a multi-channel audio signal in real-time, wherein enough processing power is not available in any case for watermark processing all channels of a current input section of said audio signal, and wherein for said watermark processing said audio signal is processed per channel in an overlap/add manner for the current input section of said audio signal and the following input section of said audio signal, said apparatus including means being adapted for:

a) determining or considering for said current input section of said audio signal a channel priority list;

b) if enough processing power is available for watermark processing the first channel of said channel priority list, watermarking the audio content of said first channel, wherein the watermark processing includes:

concatenating the input data blocks of this channel of said current input section of said audio signal and the following input section of said audio signal;

amplitude weighting, frequency transforming, watermarking and inverse frequency transforming said concatenated input data blocks;

amplitude weighting and adding the two resulting data blocks, wherein for the first section of all channels of the data stream of said audio signal the corresponding data block is amplitude weighted and added without prior watermarking processing;

else, not watermarking the audio content of this channel, and passing through the corresponding input data block;

c) repeating processing b) for the remaining channels of said current input section of said audio signal, and continuing for the following input section of said audio signal with processing b) and the first channel.

DRAWINGS

Figure 2:
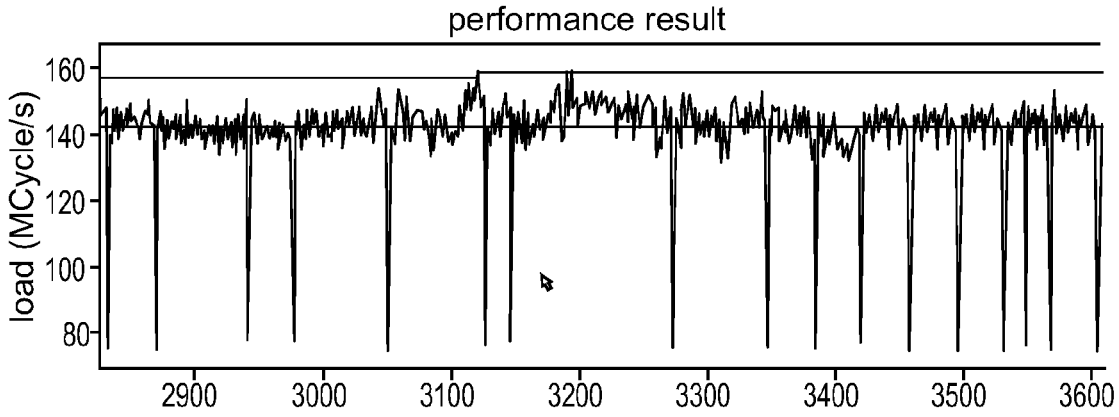
Figure 3:
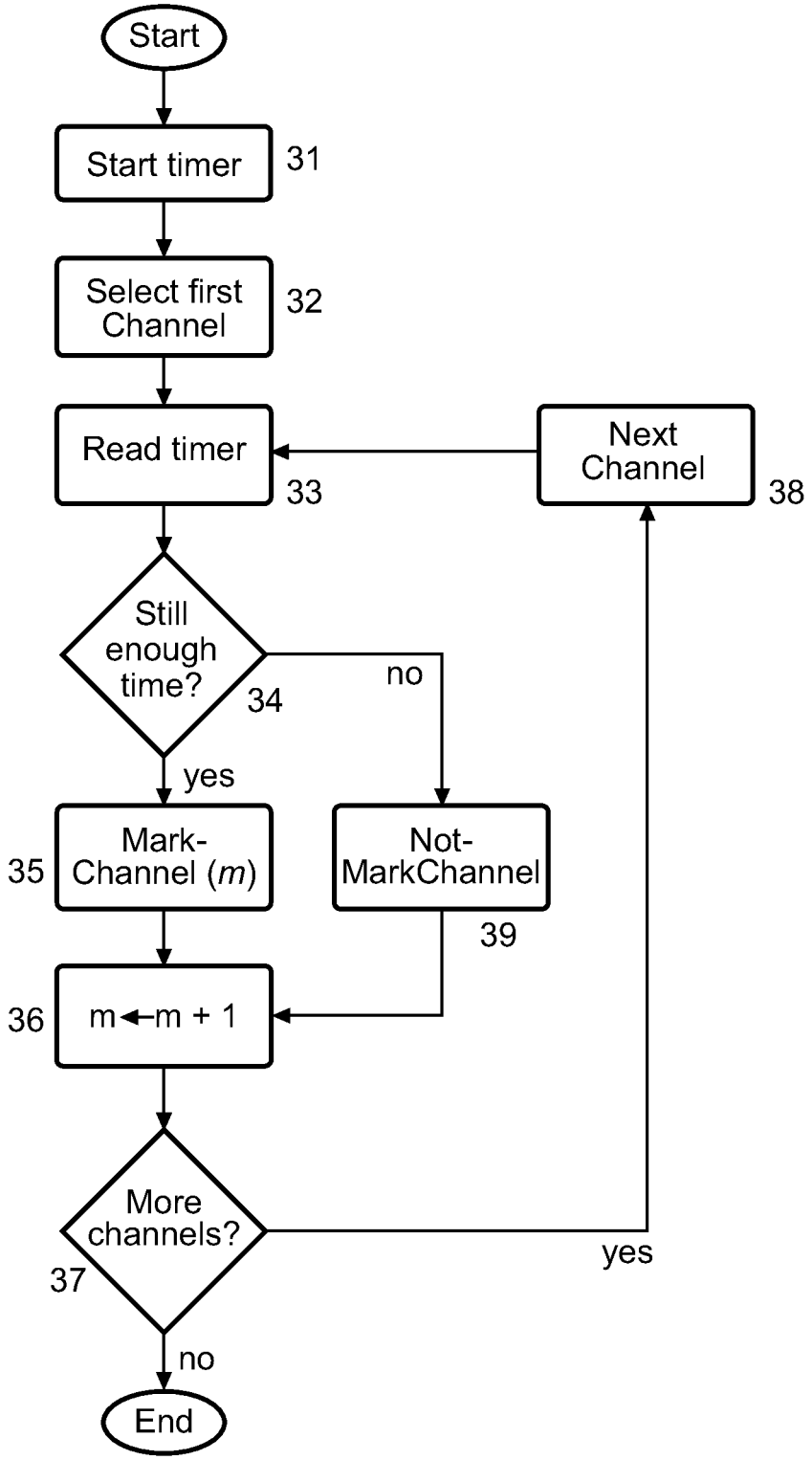
Figure 4:
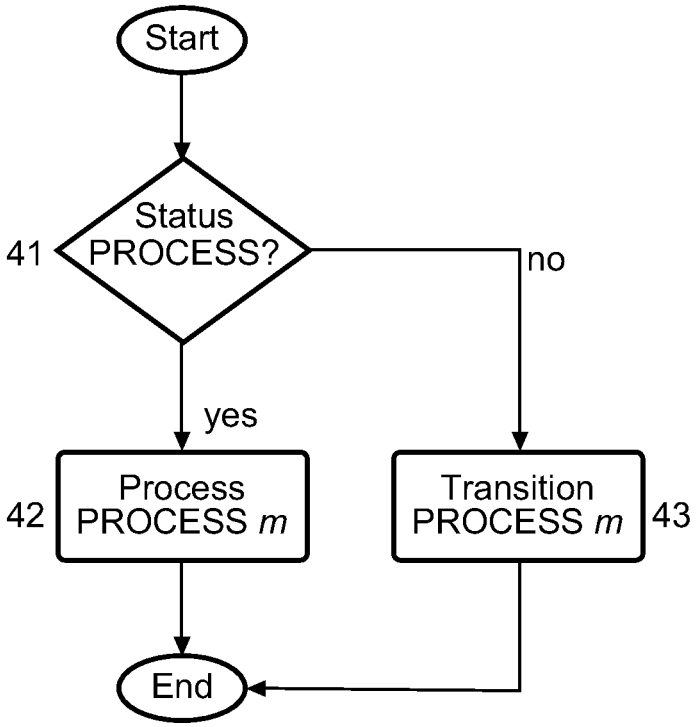
Figure 5:
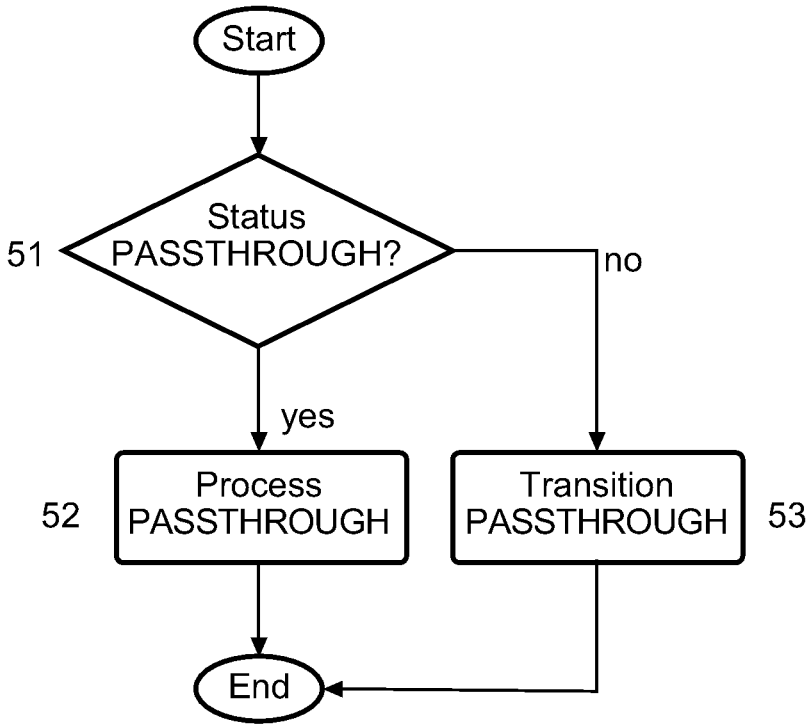
Figure 6:
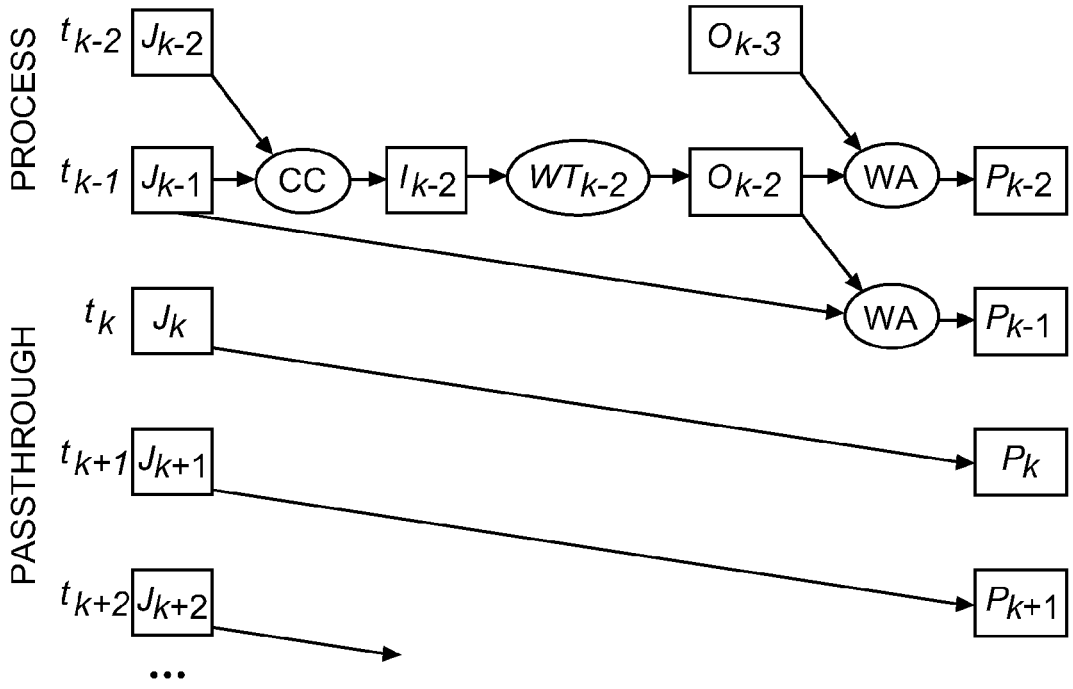
Figure 7:
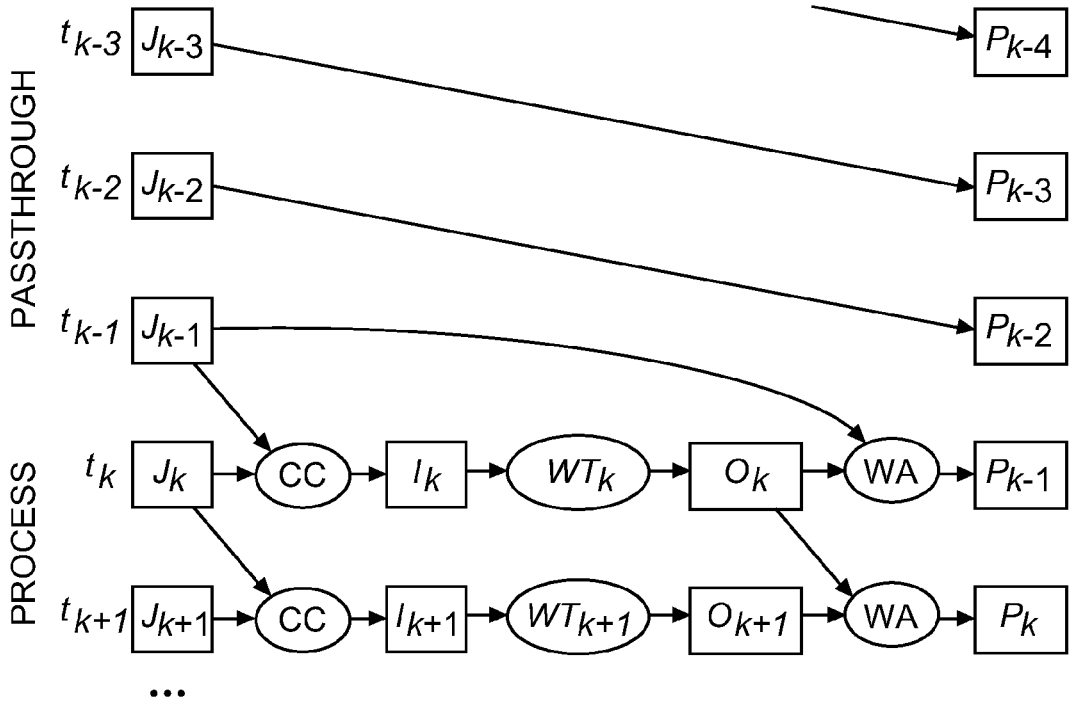

Exemplary embodiments of the invention are described with reference to the accompanying drawings, which show in:

FIG. 1 example of weighted overlap-add processing;

FIG. 2 average, maximum and current processor load used per audio signal data block in cycles over time;

FIG. 3 flow chart of the inventive processing;

FIG. 4 more detailed flow chart for the MarkChannel step;

FIG. 5 more detailed flow chart for the NotMarkChannel step;

FIG. 6 transition from state PROCESS to state PASSTHROUGH;

FIG. 7 inverse transition from state PASSTHROUGH to state PROCESS.

EXEMPLARY EMBODIMENTS

Most audio processing algorithms, be it audio coding or audio watermarking, are block based, in which a block of N input signal samples is processed at the same time and generates N output samples. The reason for such block based processing is that part of the processing is carried out in frequency domain while the input samples are in time domain, wherein typically a block of N time domain samples is transformed with the fast Fourier transform (FFT) or the modified discrete cosine transform (MDCT) and is processed in frequency domain and is transformed back to time domain using the corresponding inverse transform. Because such transforms are very efficient for a power-of-two length, a size of 512 or 1024 samples is mostly used.

A straight-forward way of block based audio processing would be to generate from the kth input block $I_k$ of size N, containing input samples k*N to (k+1)*N−1 directly the kth output block $O_k$ of size N containing output samples k*N to (k+1)*N−1. However, the input audio signal is continuous at block boundaries, i.e. at the border between input blocks $I_k$ and $I_{k+1}$, and if the content of blocks $I_k$ and $I_{k+1}$ is processed independently it will happen that the transition between the output blocks $O_k$ and $O_{k+1}$ is not continuous, resulting in audible clicking artifacts. The well-known solution for this problem is to use weighted overlap-add (WOLA) transforms in which original audio signal input blocks are weighted and overlapped, transformed, inverse transformed, and are weighted and added when forming the output signal, cf. J. B. Allen, "Short Term Spectral Analysis, Synthesis, and Modification by Discrete Fourier Transform", IEEE Transactions on Acoustics, Speech, and Signal Processing, vol. ASSP-25, no. 3, pp. 235-238, June 1977.

FIG. 1 depicts the inventive watermarking processing structure for a typical overlap of N, where $J_k$ is an original audio signal input block of size N. Every two successive blocks $J_k$ and $J_{k+1}$ are concatenated in a step or stage CC, resulting in blocks $I_k$ of length 2N and overlapping by N, such that in total every original input audio signal sample is contained twice in the I blocks.

Instead of concatenating complete blocks of length N, half blocks of length N/2 can be concatenated in a successive manner (e.g. the second half of block $J_k$ with the first half of block $J_{k+1}$, the first half of block $J_{k+1}$ with the second half of block $J_{k+1}$, the second half of block $J_{k+1}$ with the first half of block $J_{k+2}$, and so on), and the corresponding overlapping is N/2.

FIG. 1 does not depict successive channels of the same multi-channel audio signal section, but the same channel for successive sections of the multi-channel audio signal.

In step or stage $WT_k$ block $I_k$ in principle is amplitude weighted and transformed, watermark modification k is applied within the frequency domain, and the resulting block is inversely transformed, producing an output block $O_k$ of size 2N.

The transform can be an FFT, which generates from every 2N input values 2N transformed output values, and the corresponding inverse transform IFFT generates from every 2N input values 2N inversely transformed output values, or the transform can be an MDCT, which generates from every 2N input values N transformed output values, and the corresponding inverse transform IMDCT generates from every N input values 2N inversely transformed output values.

The first block $O_k$ of the current output block pair $O_k/O_{k+1}$ and the second block $O_k$ of the previous output block pair $O_{k-1}/O_k$ are amplitude weighted and added in step or stage WA to produce a final output block $P_k$ of size N. Both amplitude weightings of both blocks, at the input of $WT_k$ and in WA, are carried out such that there is an overall flat response. For example, the amplitude weighting uses sine and cosine functions so that $\sin^2+\cos^2$=constant, e.g. 1.

The first original input block $J_0$ of the audio data stream does not produce an output block according to the above-described processing. Instead, the first final output block $P_0$ is a combination of the first output block $O_0$ and original input block $J_0$. This means that the final output blocks $P_k$ are delayed by one block relative to the corresponding input blocks $J_k$:

| time step | original input block | modification | original output block |
|---|---|---|---|
| $t_0$ | $J_0$ | None | None |
| $t_1$ | $J_1$ | $WT_0$ | $P_0$ |
| $t_2$ | $J_2$ | $WT_1$ | $P_1$ |
| ... | ... | ... | ... |
| $t_k$ | $J_k$ | $WT_{k-1}$ | $P_{k-1}$ |

As mentioned above, in some applications there is not enough processing power available for watermarking all channels of a multi-channel audio data stream in real-time. This happens for example on embedded platforms like set-top boxes for TV signal reception, but also on a large server that is processing many data streams at the same time. In addition, a processor charged with performing the watermarking may also carry out other tasks like audio coding, and therefore the current load of that processor can vary over time.

Not marking all channels may degrade the security of the watermarking (WM) system because it may be possible to remove the watermarked channel without degrading too much the user experience. If for example in a 5.1 audio data stream only the left channel is marked, dependent on the content it may be possible to generate a new 2.1 audio data stream based on all channels except the left channel. Of course, in such stream no watermark can be detected.

Not marking all channels will also degrade the robustness against unauthorized microphone capture of the WM system audio output e.g. in a cinema because at the microphone stage all channels are automatically mixed together. Usually all channels are marked in the same way, which means that in this mix the watermark is added up. If, on the other hand, some channels are not marked, they simply can act as additional noise to the WM detector, which may result in non-detectability of the watermark.

The fact that the time needed for embedding the watermark is often content-dependent complicates the situation even more, as shown in FIG. 2 in which the maximum value, the average value and the current processor cycles used per block over time are depicted.

The inventive dynamic channel marking provides an optimal trade-off between real-time requirements, robustness and security. As mentioned above, in some applications it is not possible to watermark all channels of an audio data stream. Therefore the channels are prioritized. On a 5.1 setting for example, most of the audio signal content or energy is in the left, right and/or centre channels. The low-frequency effects (LFE) channel and the surround channels usually do not carry a significant amount of information. Therefore the priorities for a 5.1 audio data stream can be set to: 1. Centre, 2. Left, 3. Right, 4. Left surround, 5. Right surround, 6. LFE.

For each successive signal input block in the dynamic channel marking as many channels as possible in decreasing priority are watermarked, without violating the real-time processing power constraint and without harming audio quality due to block artifacts.

Three states of the inventive watermarking process of an audio channel are defined:

INIT is the state for the processing of the first block of the audio data stream (block $J_0$ in FIG. 1).

PROCESS is the normal processing operation state (blocks $J_1$, $J_2$ and $J_3$ in FIG. 1).

In the state PASSTHROUGH no watermarking processing is performed, but only a corresponding input block (blocks $J_k$ and $J_{k+1}$ in FIG. 6 and blocks $J_{k-3}$ and $J_{k-2}$ in FIG. 7) is returned in order to maintain data consistency.

In the FIG. 3 flow chart showing the general inventive processing, a timer is started in step 31 and the first channel of the channel priority list for the current audio signal block or section is selected in step 32 by setting the current audio channel number m to be marked to '0' (if the channel priority list starts with zero, or m is set to '1' if the channel priority list starts with '1'). In step 33 the current timer value is read, and in step 34 it is checked in view of overall real-time processing requirements whether there is still enough time for watermark processing the next channel of the audio channel priority list. In case the processor's load resulting from non-watermarking processing tasks mentioned above has decreased or increased during the watermark processing for the current audio signal input block or section, not only the running time period is evaluated in steps/stages 33 and 34 but also the remaining available processing power for the current audio signal input block or section.

If currently remaining processing power is available for watermarking processing, current audio channel m of the priority list is watermarked in step 35 and the priority list channel number m is incremented by '1' in step 36, i.e. m+1. If not true, the current audio channel m is not watermarked in step 39 and the channel priority list number m is incremented by '1' in step 36.

Step 37 checks whether there are more remaining channels in the channel priority list. If true, the next audio channel m of the audio channel priority list is selected in step 38, the current timer value in step 33 is read and the processing continues as described before. If not true, the watermarking processing for the current audio signal block or section is finished and the processing continues for the first priority list channel for the following audio signal block or section.

The channel counter m is increased independently of whether or not a current channel is watermarked. This ensures that the same modification (or a similar one because the modification may be content-dependent) is applied to all channels of one audio signal block or section, independently of whether or not some channels have been in status PASSTHROUGH.

More detailed flow charts for the MarkChannel step 35 and the NotMarkChannel step 39 of FIG. 3 are depicted in FIG. 4 and FIG. 5. In FIG. 4 it is checked in step 41 whether the current state is PROCESS. If true, the normal processing for current channel m is carried out in step 42. If not true, a transition to the state PROCESS processing for current channel m is carried out in step 43, as described in connection with FIGS. 1, 6 and 7.

In FIG. 5 it is checked in step 51 whether the current state is PASSTHROUGH. If true, the normal PASSTHROUGH processing for current channel m is carried out in step 52. If not true, a transition to the state PASSTHROUGH processing for current channel m is carried out in step 53, as described in connection with FIGS. 1, 6 and 7.

In case there is no watermarking processing power left for further channels of the current audio signal block or section, the watermarking processing state changes for remaining channels from state PROCESS to state PASSTHROUGH as depicted in FIG. 6. In the figure, the content of output blocks $P_k$ and $P_{k+1}$ corresponds to the content of input blocks $J_k$ and $J_{k+1}$, respectively.

In case during the processing of a current input signal block or section there is unexpectedly watermarking processing power left for further channels of the current audio signal block or section (for instance due to less processor power being required for a different task), the watermarking processing state can change for remaining channels of the current audio signal block or section from state PASSTHROUGH to state PROCESS as depicted in FIG. 7. This is also true in case the processing or checking of the current audio signal block or section is finished and the processing continues with watermarking processing of the first channel of the channel priority list for the following audio signal block or section. In the figure, the content of output blocks $P_{k-3}$ and $P_{k-2}$ corresponds to the content of input blocks $J_{k-3}$ and $J_{k-2}$, respectively.

Advantageously, the prioritization of the channels needs not be constant over time. For example, if in a 5.1 setting only two channels are watermarked, whereby the most important channel is the centre channel, left and right may be equally important. To make the life of an attacker more difficult it is advantageous to mark in such case the centre and left channels for a first time period and thereafter the centre and right channels for a second time period, and to repeat this alternation until the end of the audio data stream.

The invention claimed is:

1. A method for frequency domain watermark processing a multi-channel audio signal in real-time, wherein processing power is not available for watermark processing all channels of a current input section of said audio signal, and wherein for said watermark processing said audio signal is processed per channel in a manner for the current input section of said audio signal and the following input section of said audio signal, said method comprising:

a) determining for said current input section of said audio signal a channel priority list;

b) if processing power is available for watermark processing the first channel of said channel priority list, watermarking the audio content of said first channel, wherein the watermark processing includes:

concatenating input data blocks of this channel of said current input section of said audio signal and the following input section of said audio signal;

amplitude weighting, frequency transforming, watermarking and inverse frequency transforming said concatenated input data blocks;

amplitude weighting and adding the two resulting data blocks, wherein for the first section of all channels of the data stream of said audio signal the corresponding data block is amplitude weighted and added without prior watermarking processing;

else, not watermarking the audio content of this channel, and passing through the corresponding input data block;

c) repeating step b) for the remaining channels of said current input section of said audio signal, and continuing for the following input section of said audio signal with step b) and the first channel.

2. The method according to claim 1, wherein in case there is a switching from watermarking processing to non-watermarking processing, in said amplitude weighting and adding the last data block is the corresponding input data block, and wherein in case there is a switching from non-watermarking processing to watermarking processing, in said amplitude weighting and adding the first data block is the corresponding input data block.

3. The method according to claim 1, wherein said channel priority list is determined for each input section of said audio signal.

4. An apparatus for frequency domain watermark processing a multi-channel audio signal in real-time, wherein processing power is not available for watermark processing all channels of a current input section of said audio signal, and wherein for said watermark processing said audio signal is processed per channel in manner for the current input section of said audio signal and the following input section of said audio signal, said apparatus including a processor configured to:

a) determining for said current input section of said audio signal a channel priority list;

b) if processing power is available for watermark processing the first channel of said channel priority list, watermarking the audio content of said first channel, wherein the watermark processing includes:

concatenating input data blocks of this channel of said current input section of said audio signal and the following input section of said audio signal;

amplitude weighting, frequency transforming, watermarking and inverse frequency transforming said concatenated input data blocks;

amplitude weighting and adding the two resulting data blocks, wherein for the first section of all channels of the data stream of said audio signal the corresponding data block is amplitude weighted and added without prior watermarking processing;

else, not watermarking the audio content of this channel, and passing through the corresponding input data block;

c) repeating processing b) for the remaining channels of said current input section of said audio signal, and continuing for the following input section of said audio signal with processing b) and the first channel;

wherein, the apparatus further comprising an input buffer configured to receive said multi-channel audio signal.

5. The apparatus according to claim 4, wherein in case there is a switching from watermarking processing to non-watermarking processing, in said amplitude weighting and adding the last data block is the corresponding input data block, and wherein in case there is a switching from non-watermarking processing to watermarking processing, in said amplitude weighting and adding the first data block is the corresponding input data block.

6. The apparatus according to claim 4, wherein said channel priority list is determined for each input section of said audio signal.

7. A non-transitory storage medium that contains or stores, or has recorded on it, computer instructions for implementing the method according to claim 1.

* * * * *